United States Patent [19]

Graff

[11] 4,000,390

[45] Dec. 28, 1976

[54] MICROWAVE OVEN DOOR

[75] Inventor: David F. Graff, New Iberia, La.

[73] Assignee: Hobart Corporation, Troy, Ohio

[22] Filed: Feb. 14, 1975

[21] Appl. No.: 549,920

[52] U.S. Cl. ..... 219/10.55 D

[51] Int. Cl.[2] ..... H05B 9/06

[58] Field of Search ..... 219/10.55 D, 10.55 R, 219/10.55 F; 174/356 C, 35 R

[56] References Cited

UNITED STATES PATENTS

| | | | |
|---|---|---|---|
| 3,666,904 | 5/1972 | Krajewski | 219/10.55 D |
| 3,731,035 | 5/1973 | Jarvis et al. | 219/10.55 D |
| 3,736,399 | 5/1973 | Jarvis | 219/10.55 D |
| 3,803,377 | 4/1974 | Nakano | 219/10.55 D |
| 3,808,391 | 4/1974 | Graff et al. | 219/10.55 D |
| 3,809,843 | 5/1974 | Takayama | 219/10.55 D |
| 3,879,595 | 4/1975 | Lamb | 219/10.55 D |

*Primary Examiner*—Arthur T. Grimley
*Attorney, Agent, or Firm*—Biebel, French & Nauman

[57] ABSTRACT

A microwave oven door is fabricated using a rectangular structural frame. The frame is composed of two horizontal extruded members which are fastened at their ends to vertical cast end caps. Each of the end caps includes a door latch arrangement for engaging strikers mounted on the oven cabinet. The frame positively contains a stiffening member which may further be attached to the frame by an adhesive. Fastened to the stiffening member is a capacitive seal which is free to flex at its periphery. The capacitive seal is circumscribed by a secondary seal which is attached to the frame.

10 Claims, 9 Drawing Figures

MICROWAVE OVEN DOOR

BACKGROUND OF THE INVENTION

The present invention relates to a unique door assembly for microwave ovens. In microwave heating appliances, the nature of the heating phenomenon is that of stressing certain of the molecules of the product to be heated by using an electromagnetic field, commonly in the heating frequency range of 2,450 MHz. One of the more serious problems with such microwave oven devices has been concern about radiation leakage and the resulting possibility of operator injury. As a result, the current Bureau of Radiological Health standards require that microwave ovens allow a leakage of no more than 1 milliwatt per square centimeter at the factory and 5 milliwatts per square centimeter in the hands of the ultimate user.

The primary area of such radiation leakage is the periphery of the oven door and for this reason a number of door designs have been developed to limit this leakage. Many oven doors use a choke seal to limit radiation leakage. Such a seal commonly comprises a cavity circumscribing the internal edge of the oven door. The choke seal cavity dimensions are specified in terms of fractions of the wavelength of the electromagnetic radiation to be suppressed. This type of seal is disclosed in U.S. Pat. Nos. 3,809,843; 3,678,238; 3,502,839; and 3,511,959.

Choke seals are somewhat disadvantageous in that they are highly frequency selective. Since the dimensional configuration of such a seal cavity is dependent on wave length, this type of seal generally will not be effective to suppress the harmonic frequencies which are commonly present. One approach taken to suppress such harmonics is to provide more complicated choke cavity structure. A microwave choke seal arrangement for suppression of both fundamental and second harmonic frequencies is disclosed in U.S. Pat. No. 3,668,357.

Another type of seal used to suppress leakage of microwave radiation is a capacitive seal, such as shown in U.S. Pat. No. 3,808,391. The seal plate disclosed therein is a thin metallic plate which covers the oven cavity and presses firmly against the edges of the cavity. The surface of the plate has a thin coating of a suitable dielectric organosol. Surrounding the capacitive seal is a conductive sealing ring which acts as a secondary seal. Since the seal plate necessarily must be allowed to flex to a certain degree, the secondary seal must not be positioned so as to interfere with flexure of the capacitive seal. This dimensional stability requirement plus the need for an extremely rugged door resulted in a relatively expensive door construction.

SUMMARY OF THE INVENTION

In accordance with the present invention a door assembly for a microwave oven is provided which has a rectangular structural frame means composed of at least four frame elements, a hinge means mounting the frame means to the oven cabinet, a capacitive seal plate mounted on the frame means, and a resilient material between the frame means and the seal plate. It is contemplated that such a door will be most effectively used with a microwave oven cabinet having a flat front surface around the orifice leading to the cooking cavity. With the door latched or otherwise urged to closed position, the resilient material between the frame and the seal plate therefore will urge the seal plate into close contact with this flat front surface. The structural frame means further comprises a stiffening member attached to the frame elements and providing a point of attachment for the seal plate. The stiffening member is attached to the frame elements by an adhesive and therefore the exact dimensions of the stiffening member are not critical even though the positioning of the capacitive seal is critical.

In order that such a door may be constructed in the most economical manner and yet retain dimensional stability and structural rigidity, the door elements are advantageously produced as extrusions and castings. The frame may be produced with upper and lower horizontally positioned extruded rails and first and second end caps vertically positioned respectively at the right and left ends of the upper and lower rails so as to define a rectangular frame. Since the end caps are cast and since the holes provided in the end caps for the connecting bolts are cast into those end caps, the overall dimensional stability of the frame is assured.

Accordingly, it is an object of this invention to provide a simple and economically constructed door for a microwave oven which effectively prevents radiation leakage comprised of a rectangular structural frame; to provide such a door which is dimensionally stable; and to provide such a door with a capacitive seal plate and a resilient member which can urge the seal plate into contact with a surface of the oven surrounding the door.

Other objects and advantages of the invention will be apparent from the following description, the accompanying drawings and the appended claims.

DETAILED DESCRIPTION OF THE PREFERRED EMBODIMENT

Figure 1:
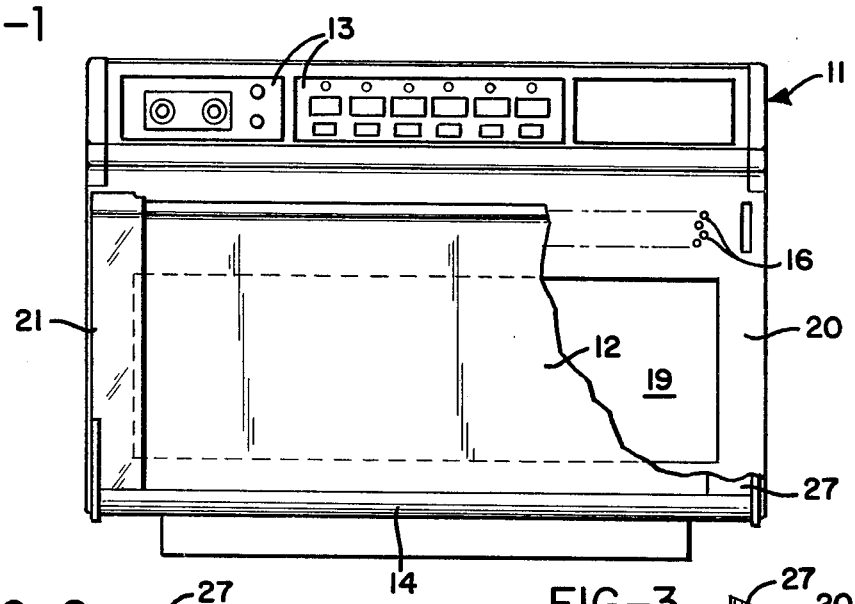
FIG. 1 is a front elevation view of a microwave oven with a portion of the door broken away.

Referring to FIG. 1 there is shown a microwave oven 11 having a partially broken away door assembly 12 constructed in accordance with the present invention. The illustrated microwave oven is equipped with one or more magnetrons delivering microwave energy in the radio frequency band of 2,450 MHz for rapidly reheating, cooking, and/or defrosting of food.

The controls 13 for oven 11 are mounted above the oven door. The door is of an up-opening type with bar 14 provided for unlatching the door. Door 12 shields holes 16 to prevent a foreign object from being inserted through the holes during oven operation while at the same time allowing steam given off by the food being cooked to escape from the oven cavity or cooking chamber 19. Vent holes 16 are of sufficiently small size that no microwave radiation leakage is permitted. It should be noted that door 12 overlaps the substantially flat front surface 20 of the oven cabinet.

Figure 2:
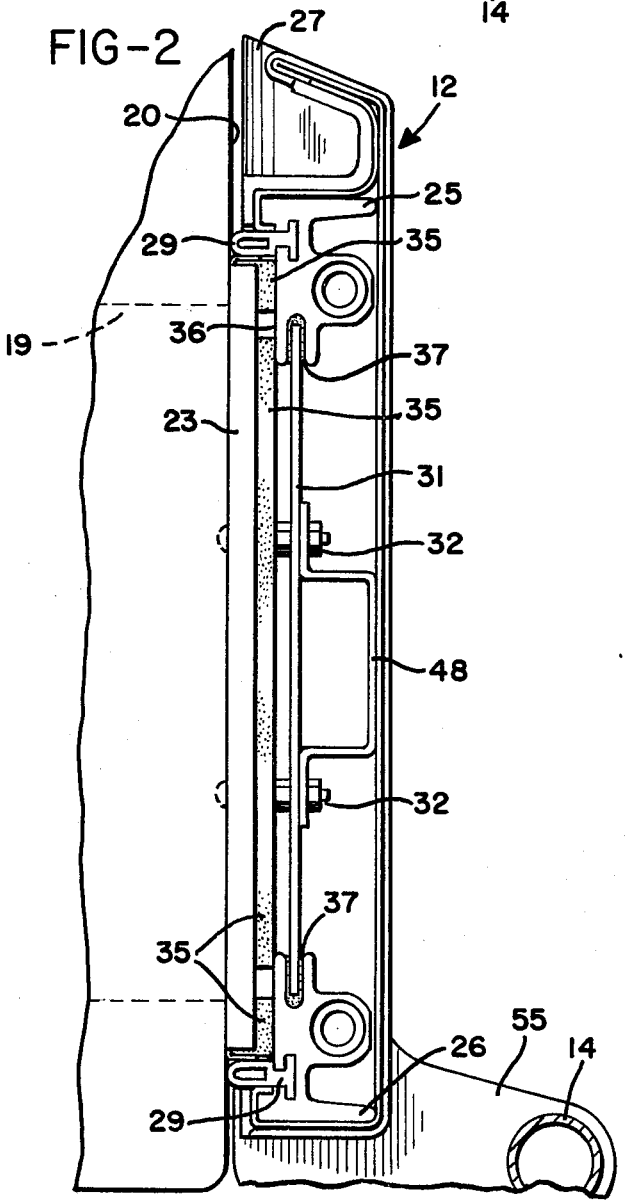
FIG. 2 is a fragmentary side view showing details of the door structure of the preferred embodiment with the left end cap removed, as seen looking left to right in FIG. 1.
Figure 3:
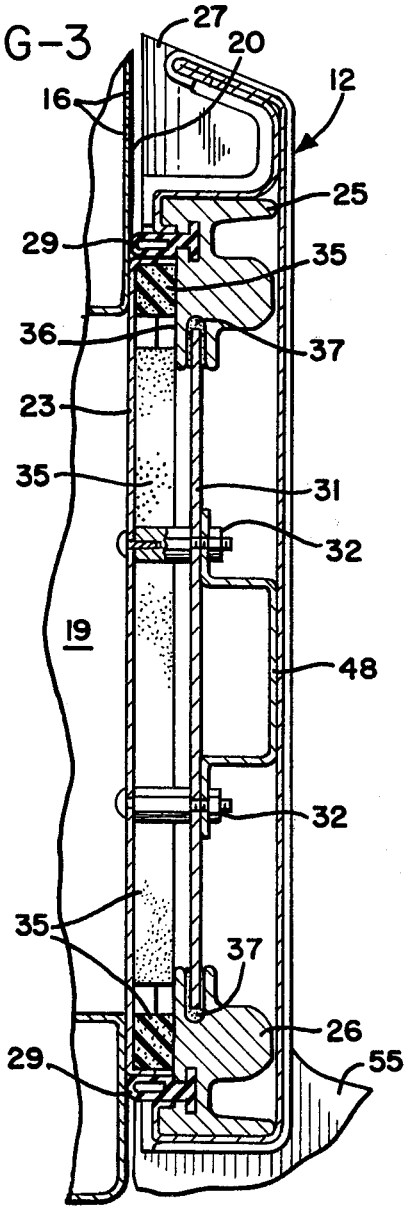
FIG. 3 is a sectional view taken on line 3—3 of FIG. 5.

In FIGS. 2 and 3, the door construction of the preferred embodiment is shown respectively in an end view with end cap 21 removed, and in a cross-sectional view. The main or primary seal utilized in the preferred embodiment illustrated is a capacitive seal plate 23 which may be a thin stainless steel plate coated with a dielectric paint. This capacitive seal plate overlaps and firmly contacts the flat front surface 20 of the microwave oven cabinet around the opening leading to cooking chamber 19 when the door is closed.

A rectangular structural door frame is comprised of an upper horizontal member 25 and a lower horizontal member 26. Typically, frame members 25 and 26 are formed as extrusions and are then cut to produce a door frame of desired length. These upper and lower horizontal members are connected to right and left vertical end caps or end members to complete the rectangular frame. Typically these end cap pieces will be made of cast zinc.

Surrounding capacitive seal plate 23 is a secondary seal 29 composed of a strip of conductive rubber or the like to dissipate radiation which may pass the primary capacitive seal. It should be noted that the conductive rubber strip is positively held by grooves in the rectangular frame.

A stiffening member or door panel member 31 is held within the rectangular frame. The stiffening member 31 is provided with mounts 32 to which are attached the capacitive seal 23. This mounting arrangement is such that the periphery of the capacitive seal is free to flex and thus insure a more positive contact with front surface 20 of the oven cabinet. Strips of a resilient material 35 are positioned on a substantially flat seating surface 36 in the rectangular frame to urge capacitive seal plate 23 against the front surface of the oven cabinet when the door 12 is closed.

Because of the requirement that the periphery of the capacitive seal plate be free to flex, it is important that the capacitive seal plate be positioned so that it does not tightly abut the secondary seal 29. Construction of a door meeting this requirement is facilitated by the use of an adhesive 37 in a recess in the frame members for attaching the stiffening member 31 to the rectangular frame. An adhesive such as an epoxy adhesive or a filled epoxy adhesive which will decrease the resiliency of the cured adhesive may advantageously be utilized for this purpose. The stiffening member 31 will normally be attached to the frame members 25 and 26 while the parts are held by a jig in precise dimensional relationship to each other. When the door is constructed in this manner, dimensional variations in the stiffening member are taken up in the adhesive connection to the frame so that the capacitive seal is positioned precisely within the confines of the secondary seal.

Figure 4:
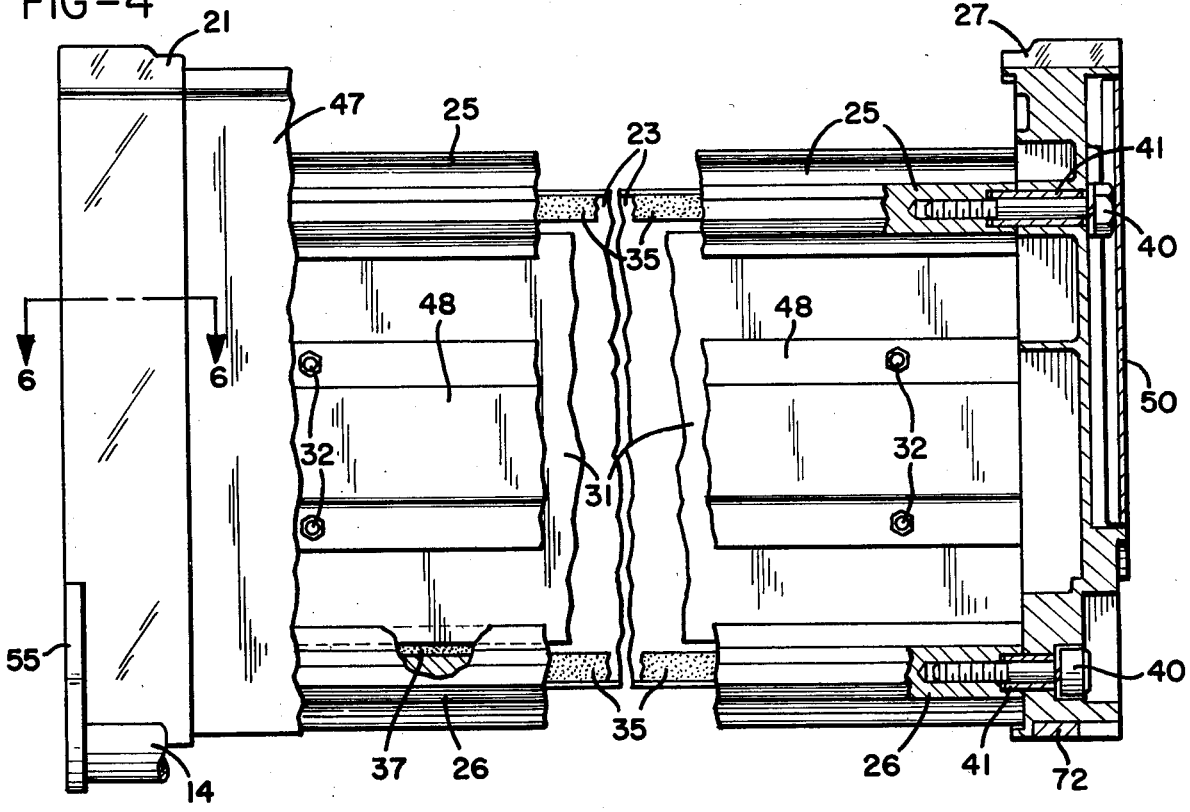
FIG. 4 is a front view of the preferred embodiment of the invention with portions broken away and partially in section.

FIG. 4 shows the rectangular frame constructed in greater detail. Left end cap 21 and right end cap 27 are shown connected to upper horizontal member 25 and lower horizontal member 26. The end caps and horizontal members are connected by bolts 40. The bolts pass through holes in the end caps containing sleeves 41, and are threaded into the horizontal members. Since the holes in the end caps are cast, a machining operation is eliminated while at the same time insuring that the dimensionality of the door is precisely controlled.

Figure 5:
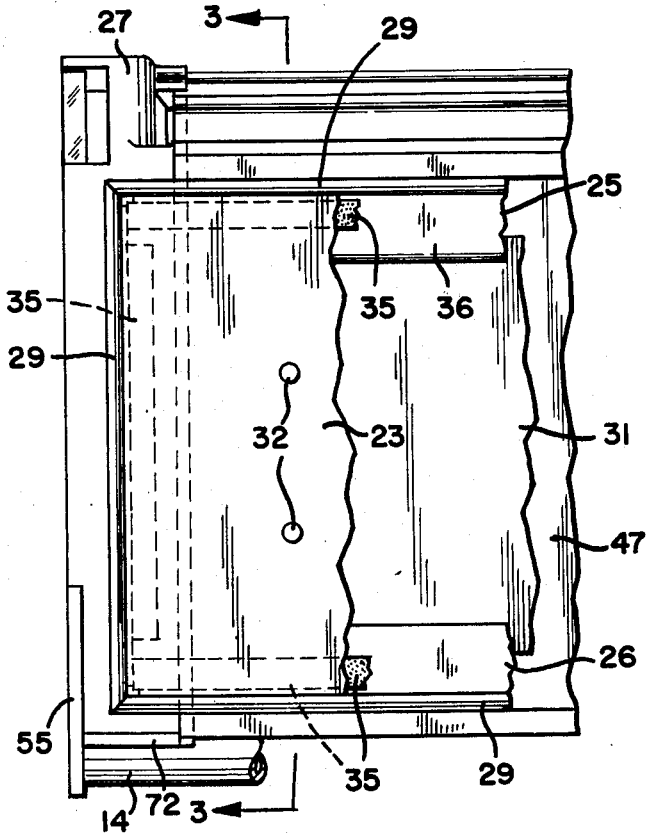
FIG. 5 is a rear view of the door structure with portions broken away.
Figure 6:
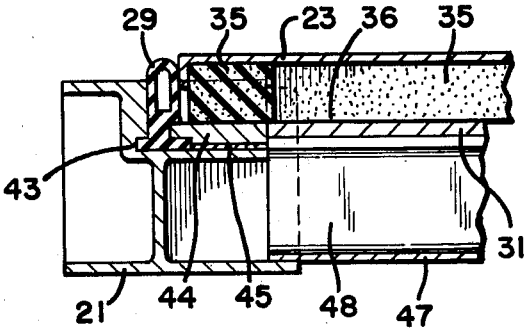
FIG. 6 is a sectional view taken on line 6—6 of FIG. 4.

FIG. 5, a partial view of the oven door as seen from the interior of the oven, shows clearly the manner in which capacitive seal plate 23 is backed with resilient material 35 which rests upon seating surface 36. This surface extends around the entire frame, as shown in FIG. 6. Also shown in FIG. 6 is the manner in which the secondary seal 29 is attached to the rectangular frame in the end caps. A groove 43 is formed in the end caps for the attachment of the secondary seal by means of a metal strip 44 which is attached to the end cap with double sided tape 45. These metal strips 44 also provide those parts of the seating surface 36 on the end caps.

Figure 7:
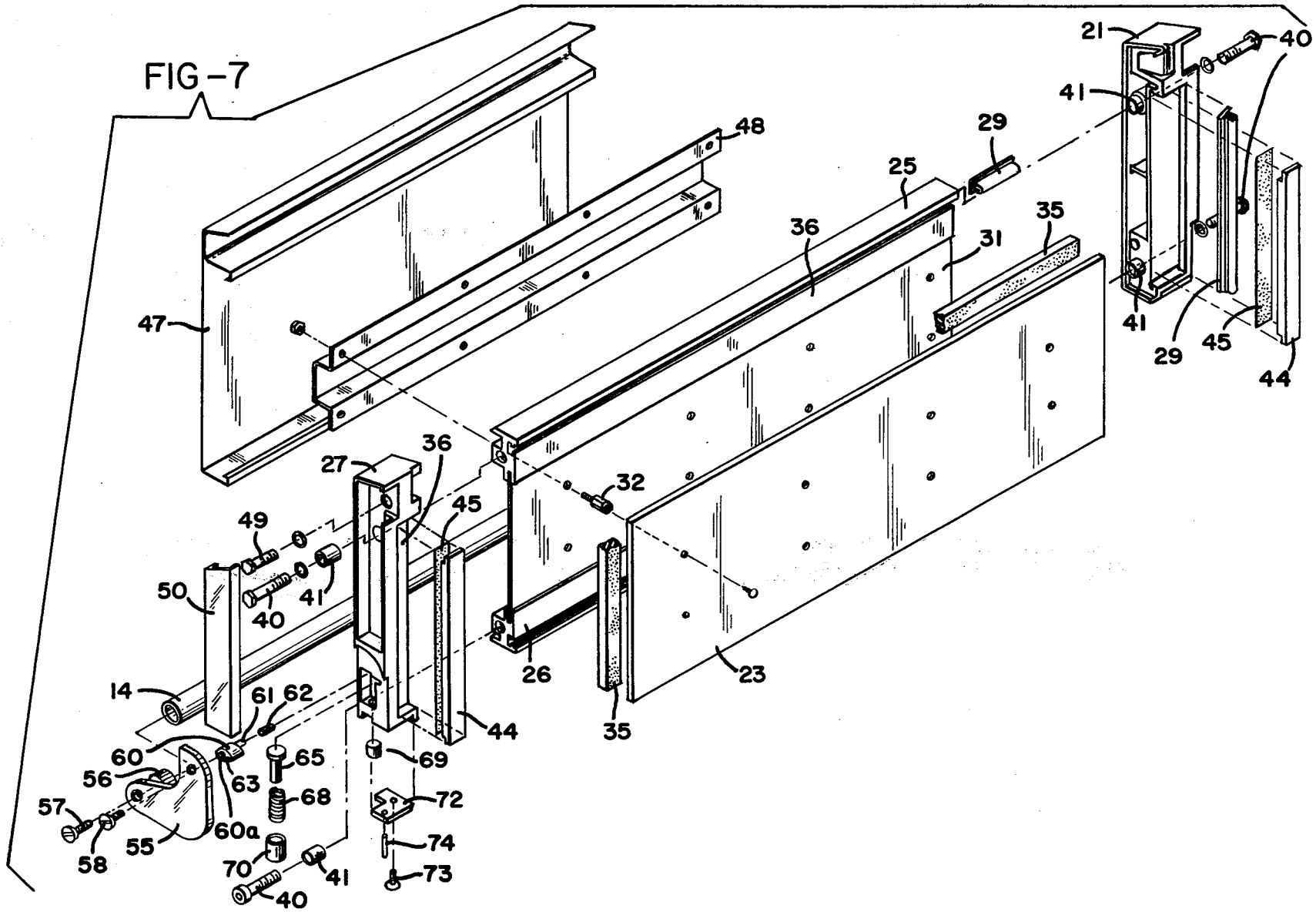
FIG. 7 is an exploded view illustrating details of the door construction.

The complete door is shown in FIG. 7 in an exploded view. The door includes a decorative cover 47 which may be made of stainless steel. This cover is shaped so as to engage the upper and lower horizontal members and is further supported by a U-shaped channel member 48. A bolt 49 is provided at each end cap as a means of securing a hinge (FIG. 9) to the door along with upper bolts 40. Decorative trim 50 covers bolts 40 and 49 to provide a smooth outer surface which is easy to clean. Latch bar 14 is connected to plate 55 and to an identical plate (see FIGS. 8 and 9) at its opposite end. The connection between bar 14 and plates 55 can be made in any suitable way. One arrangement found desirable involves the use of a diagonally split plug 56 and a clamping screw 57 extending through plate 55 and loosely through the part of the plug adjoining the plate. The end of screw 57 is threaded into the inner part of the plug, and tightening the screw causes the plug parts to exert radially outward clamping force against the inner walls of the tubular bar 14. Such devices are well known and their details are not part of this invention.

A latching assembly is provided within each end cap. One of these assemblies is shown to the left of FIG. 7 in exploded fashion, and the assembly is also shown in an unlatched position in FIG. 9, and in a latched position in FIG. 8. Effectively, the latch bar 14 and the latch end plates 55 move as a unit due to their interconnection. The latch plates are mounted for rotation in the door frame by studs 58 which extend through an appropriate hole in the plate and thread into a cam 60. The axis of rotation of the cam is along the center line of the screw 58, and on that axis the cam has a short pin-like hollow projection 60*a* which engages within a counter-bored portion of the latch plate hole (not shown). On the same axis at the opposite end of the cam there is a pin 61 which projects into a bushing 62 received in an appropriate hole in the end cap. Offset from the projection 61 is a small pin 63 extending from the cam into a blind hole on the inside of the latch plate, providing for concurrent rotation of the latch plate and the cam.

Pulling upward on bar 14 causes the end plates 55 to rotate, rotating the cams 60 with them and this action causes the cams to push downward on plungers 65 (FIGS. 7 and 9) against the force of springs 68. The downward travel of plungers 65 is guided by a smaller lower bushing 69, and the upper bushings 70 which surround the springs also provide stops limiting downward travel of the plungers. A striker plate 72 is attached to the bottom of each of the end caps by a stud 73 (FIG. 7) and pin 74, so as to engage the latching mechanism attached to the oven cabinet.

Figure 8:
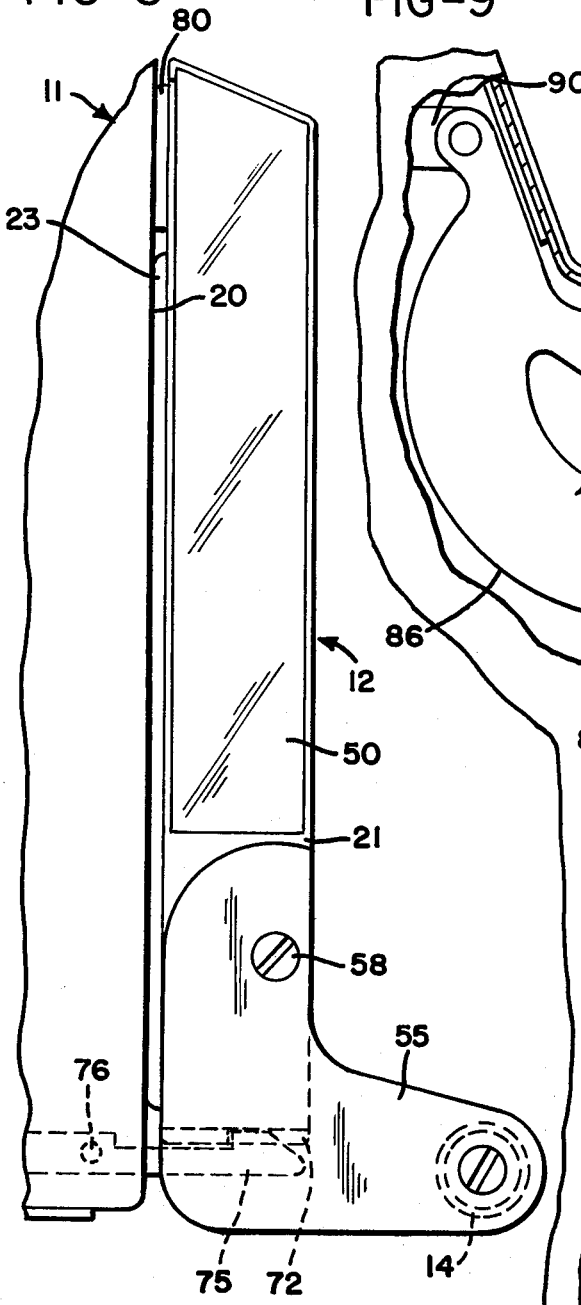
FIG. 8 is a partial end view of the door in its closed position on the face of the oven.
Figure 9:
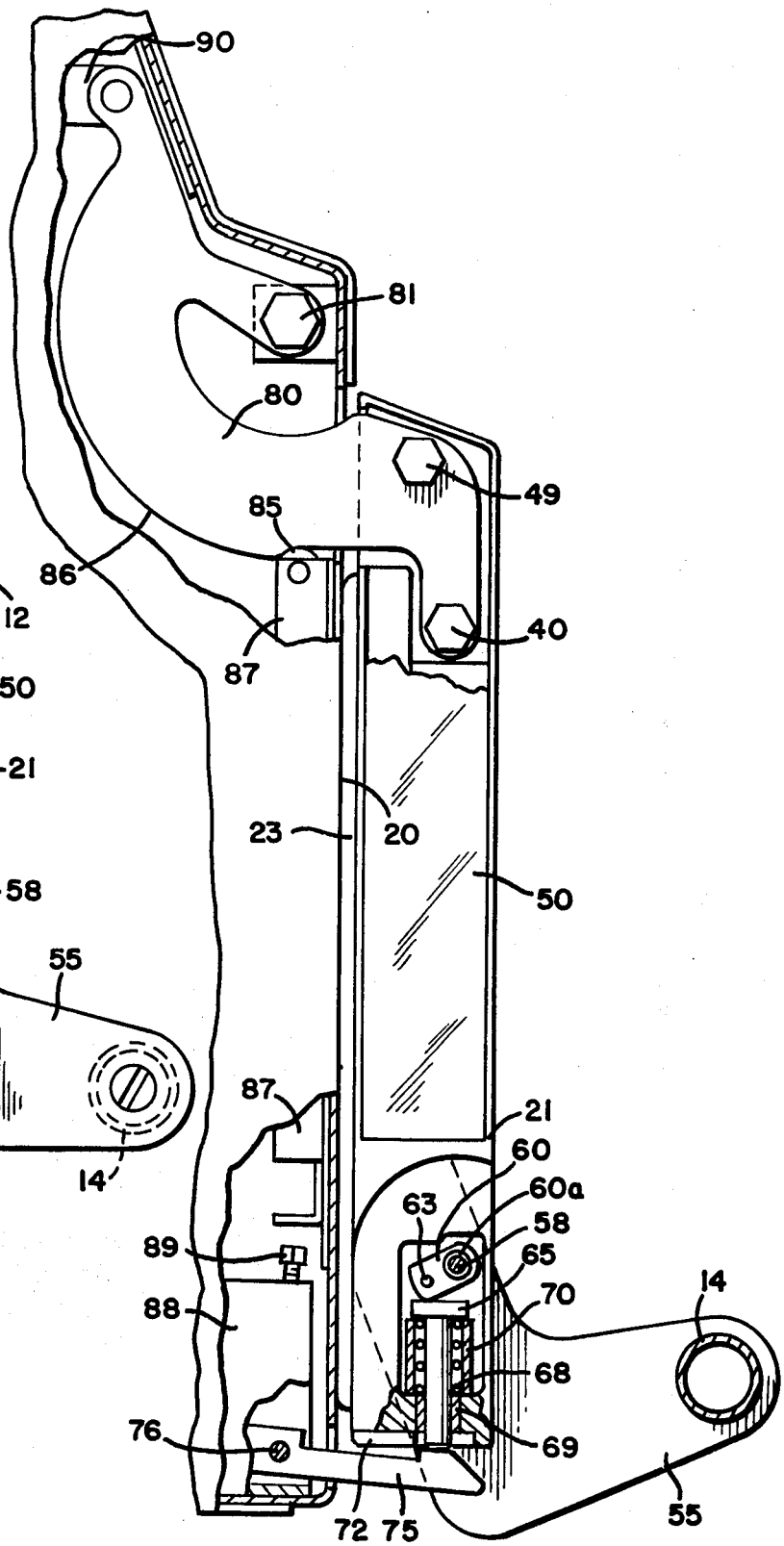
FIG. 9 is a partial end view of the door and oven with parts broken away to reveal internal structure.

This engagement mechanism and the oven door hinge are shown in FIGS. 8 and 9. Striker 75 is a bar of hardened steel shaped so as to interlock with striker plate 72. The striker is hinged so as to rotate vertically about pivot 76 and is spring biased to a horizontal position as shown in FIG. 8. The door is unlatched by raising bar 14 and thereby causing plunger 65 to push downward on striker 75.

At the top of the door hinge 80 rotates about stud 81 and is shaped so as to be internal to the oven cabinet and therefore hidden when the door is closed. A cam follower 85 rides upon cam surfaces 86 on hinge 80 and when the door is open depresses a plunger 87 which is operatively connected with interlock 88 so as to prevent oven operation when the door is opened. Interlock 88 prevents operation of the oven when the striker 75 is depressed to unlatch the door, or when the bolt 89 is depressed by plunger 87 as the door is opened. This interlock arrangement is disclosed in greater detail in copening U.S. application Ser. No. 549,964, filed on even date herewith and assigned to the assignee of the present invention. Hinge 80 is also attached to linkage 90 which is part of a counter balancing arrangement provided to aid in opening and closing the oven door. The hinge arrangement is disclosed in greater detail in copending U.S. application Ser. No. 549,965, filed on even date herewith and assigned to the assignee of the present invention.

While the forms of method and apparatus herein described constitute a preferred embodiment of the invention, it is to be understood that the invention is not limited to these precise forms of method and apparatus, and that changes may be made therein without departing from the scope of the invention.

What is claimed is:

1. In a microwave oven having an oven cabinet defining a cooking cavity, said cabinet having a front surface around a central orifice opening into said oven cavity, an improved oven door comprising:

a fabricated rectangular structural frame means including top, bottom and side frame elements secured together, hinge means mounting said frame means to said oven cabinet, a capacitive seal plate dimensioned to cover said orifice and mounted on said frame means with the periphery of said plate free to flex respect to said frame means, and a resilient material between said frame means and said seal plate to urge said periphery of said seal plate into close contact with said flat front surface when said door is closed.

2. The microwave oven of claim 1 wherein said structural frame means further comprises a stiffening member attached to said frame elements, and means attaching the central part of said seal plate to said stiffening member.

3. The microwave oven of claim 2 wherein said stiffening member is captured within said frame elements and attached to said frame elements by an adhesive.

4. A microwave oven comprising:

an oven cabinet defining a cooking cavity and an opening to said cavity, and a door mounted on said cabinet to cover said opening, said door comprising:

an upper member positioned horizontally and having a seating surface running substantially the length thereof, a lower member positioned in spaced relation to and beneath said upper member and also having a seating surface running the length of said lower member, first and second end caps each having a seating surface and engaged with the ends of said upper and lower members to define a rectangular frame, and a rectangular primary capacitive sealing means having a sealing face and including resilient means acting against the reverse side of said sealing means from said sealing face, said resilient means being positioned to contact the seating surfaces of said upper and lower members and said end caps and to urge said sealing face into contact with said cabinet when said door is closed.

5. An oven as defined in claim 4 further including a secondary seal circumscribing said sealing face.

6. The oven of claim 4, wherein said first and second end caps are complementary castings, and said upper and lower members are extrusions of like configurations.

7. The microwave oven of claim 4 wherein said upper and lower members are attached to said end caps by bolts which pass through said end caps and longitudinally into said upper and lower members.

8. The microwave oven of claim 4 further comprising latch plates pivotably mounted to each of said end caps, and a bar extending across said door and fixed to said latch plates for concurrent movement thereof.

9. A microwave oven comprising an oven cabinet defining a cooking cavity and an opening into said cavity, and an oven door mounted on said oven cabinet for covering said orifice, said oven door including:

upper and lower horizontal members and right and left end caps assembled to form a rectangular frame, a rectangular stiffening member mounted within said frame, a capacitive seal member attached to said stiffening member and adapted to contact said cabinet around said opening into said cooking cavity when said door is closed, resilient means between said frame and said capacitive seal member to urge said seal member into contact with said cabinet when said door is closed, and bolts accessible from said end caps and extending through said end caps and longitudinally into said upper and lower horizontal members to secure said frame in assembled condition.

10. The oven of claim 9 further comprising an adhesive attachment of said stiffening member to said frame to permit precise location of said seal member during assembly of the door without maintaining close tolerance in the construction of said frame.

* * * * *